US005150012A

United States Patent [19]

Pringle et al.

[11] Patent Number: 5,150,012

[45] Date of Patent: Sep. 22, 1992

[54] LOW PRESSURE XENON LAMP AND DRIVER CIRCUITRY FOR USE IN THEATRICAL PRODUCTIONS AND THE LIKE

[75] Inventors: David A. Pringle, 16749 Bollinger Dr., Pacific Palisades, Calif. 90272; David McDonald, Canyon Country, Calif.; Zhong F. Yan, Shanghai, China

[73] Assignee: David A. Pringle, Pacific Palisades, Calif.

[21] Appl. No.: 712,868

[22] Filed: Jun. 7, 1991

[51] Int. Cl.[5] ..... H05B 41/36

[52] U.S. Cl. ..... 315/200 A; 3115/246; 3115/314; 3115/360

[58] Field of Search ..... 315/200 A, 360, 208, 315/DIG. 7, 241 P, 241 S, 349, 246, 314, 315, 316, 225, 250

[56] References Cited

U.S. PATENT DOCUMENTS 4,149,113 4/1979 Sammis ..... 315/200 A
4,687,985 8/1987 Pitel ..... 315/360

*Primary Examiner*—Eugene R. LaRoche
*Assistant Examiner*—Michael B. Shingleton
*Attorney, Agent, or Firm*—Ladas & Parry

[57] ABSTRACT

Disclosed is a low pressure xenon lamp and the driver circuitry therefore for producing relatively short bursts of intense light from the lamp. The lamp, including its associated driver circuitry, can be used in theatrical, stage, movie and/or video productions to simulate, among other things, bursts of lightning. The lamp is installed in a fixture together with a power supply and a control system is provided for controlling when the lamp is turned on and off. Preferably, the control system includes manually operated switches and preferably one or more controllers can be coupled together in a series fashion, should it be desired to control the lamp for a greater number of time cycles then permitted by a single controller.

10 Claims, 5 Drawing Sheets

LOW PRESSURE XENON LAMP AND DRIVER CIRCUITRY FOR USE IN THEATRICAL PRODUCTIONS AND THE LIKE

TECHNICAL FIELD

The present invention provides a lamp and associated driver circuitry which is programmable for the purpose of producing precisely controlled, full intensity, short bursts of light for use in theatrical productions, on stage, in video productions and the like. The light produced is intense and of a relatively short duration, and multiple bursts can be generated. Therefore, the lamp and associated driver circuits can be effectively used to simulate a bolt of lightning or a number of bolts of lightning.

BACKGROUND

In theatrical, stage, and video productions, relatively short bursts of white light are sometimes used to mimic bolts of lightning. In the prior art, the light was produced by a manually operated scissors switch wherein a DC current was drawn between carbon electrodes and the switch was manually operated so as to draw and extinguish the arc in a manner more or less mimicking bolts of lightning.

This prior art technique suffers from a number of drawbacks. First, there is the obvious safety question of using a person to manually draw an arc using a scissors switch between two electrodes. Second, even when the scissors switch can be used safely, its use takes a toll on the DC generators used to produce the power to draw the arc. Third, since the scissors switch is manually operated, the mimicked lightning bolts were not repeatable. Thus, for stage or theatrical productions, the lighting bolts would not be repeatable from performance to performance, and therefore they could not be easily timed to music or other events occurring during the performance. For movie or video work, when the same scene goes through a number of takes, each of the takes would have a different lightning display, thereby making it more difficult to edit the movie or video with scenes from different takes.

The present invention overcomes these difficulties by providing a lamp and driver circuitry for use therewith which can produce short, intense bursts of light, such as what might be used to mimic a bolt of lightning, in a manner which is safe, easily programmable and repeatable, and, moreover, does not require a DC generator and therefore does not adversely impact a DC generator.

BRIEF DESCRIPTION OF THE INVENTION

In one aspect the present invention provides a high tensity, intermittently operated lamp for use in theatrical, stage, movie and video productions. The lamp comprises an elongated tube having electrodes disposed at the ends thereof, which tube is filled with xenon gas at a pressure less than atmospheric pressure. The lamp produces on the order of 70 to 80 lumens per watt when its electrodes are energized.

In another aspect the present invention provides a high intensity lighting system for use in producing relatively short bursts of intense light. The system includes a lamp containing xenon gas at a pressure less than atmospheric when cold, an igniter, and a switching circuit connected in series with the lamp and the igniter. The circuit couples the lamp and the igniter to a source of electrical power in response to a control signal. A control circuit generates the control signal, the control circuit including manually operated switches for controlling when the control signal is turned on and turned off. The control circuit also includes a safety circuit for limiting the on time period of the control signal to a predetermined maximum time period.

In another aspect the present invention provides a high intensity lighting system for use in producing relatively short bursts of light, wherein the system includes a lamp, a power supply coupled to the lamp and responsive to a control signal for applying electrical power to the lamp, and a control circuit for generating the control signal. The control circuit includes a counter for counting through a predetermined number of states and multiplexer means responsive to said counter and to the state of selected switches so that the control signal is generated for each state of the counter when its associated switch is in a predetermined state.

In yet another aspect the present invention provides a high intensity lighting system for use in producing relatively short bursts of light, the lighting system including a lamp containing xenon gas and a power supply coupled to said lamp for igniting the lamp in response to a control signal. A control circuit is disposed in a housing located remotely from the lamp, but operationally connected thereto, for providing the control signal to the power supply. The control circuit includes manually operated switches for controlling when the control signal is turned on and off, the housing including connectors for coupling the control signal via a cable to the power supply and further including additional connectors for connecting the control circuit to yet another control circuit in a separate housing thereby increasing the number of manually operated switches available for controlling when the control signal is turned on and off.

DETAILED DESCRIPTION

Figure 1:
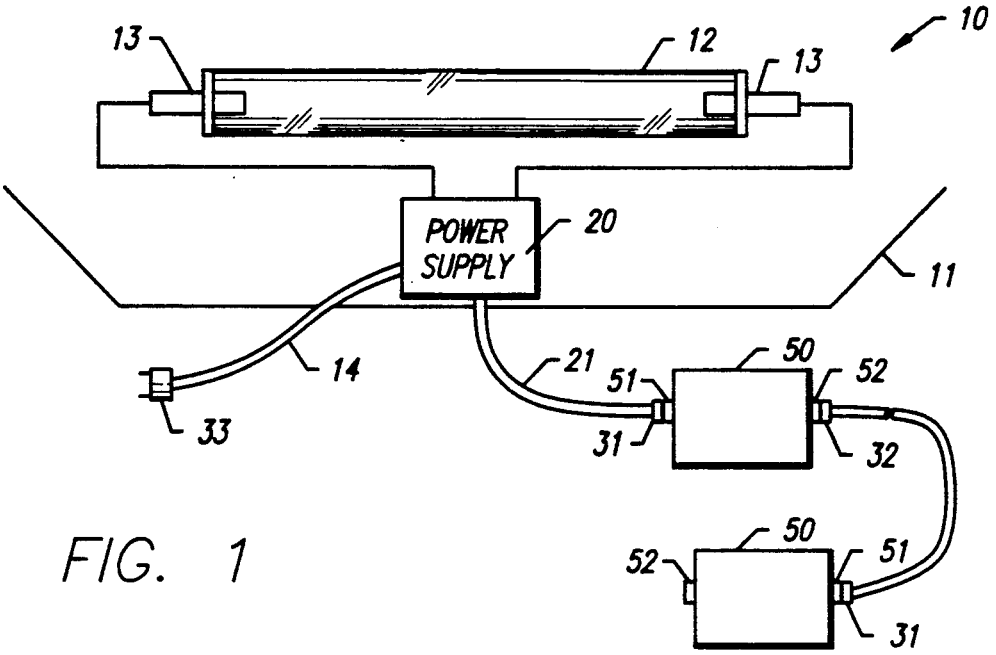
FIG. 1 is a schematic representation of the lamp of the present invention installed in a fixture and this figure also depicts box diagrams of the circuits used to drive the lamp.

FIG. 1 is a schematic representation of the lamp 10 used in the present invention, as well as depicts, using box diagrams, the power switch and igniter 20 which powers the lamp and a controller 50 which controls the power switch 20. As will be described, multiple controllers 50 may be used in the preferred embodiment.

The lamp is typically mounted in a lamp head or other suitable fixture 11. Since such fixtures are well known in the prior art and since means for mounting lamps in fixtures are well known in the prior art, those details, which are a matter of design choice, are not described herein. The lamp itself and the power switch and controllers which control it, are unique, and therefore are described in detail.

The lamp 10 comprises an elongated glass tube 12, preferably quartz glass, which is sealed at its ends about electrodes 13 which are preferably made of tungsten. The overall length of the lamp, including its electrodes, is typically on the order of 660 mm while the inter-electrode spacing between the two electrodes is on the order of 500 mm. Thus, the arc drawn in the lamp is rather long. The lamp is filled with xenon gas at a pressure of 0.2 to 0.3 atmospheres at ambient temperature. This lamp can be energized with 220 volts AC current and it will then draw 20 to 80 amps and produce 70 to 80 lumens per watt with a Color Rendition Index of 94–96. The lamp has a diameter of approximately 25 mm. When hot, the xenon pressure will increase above one atmosphere.

The power supply and igniter 20 will be described in greater detail with reference to FIG. 2. The power supply receives 220 volt AC power, typically via a cable 14 and conventional connector 33. The power switch and igniter 20 conveys 12 volt AC power to and receives control signals from one or more controllers 50 via cable 21 which has a connector 31 disposed at the end thereof. Connector 31 mates with a connector 51 on controller 50. The controllers can preferably be connected together in a series fashion by means of cables 33 having connectors 32 and 31 at the ends thereof.. Connector 32 mates with connector 52 on controller 50 while connector 31 mates with connector 51 on those controllers which are not connected directly to the power switch and igniter 20.

Figure 2:
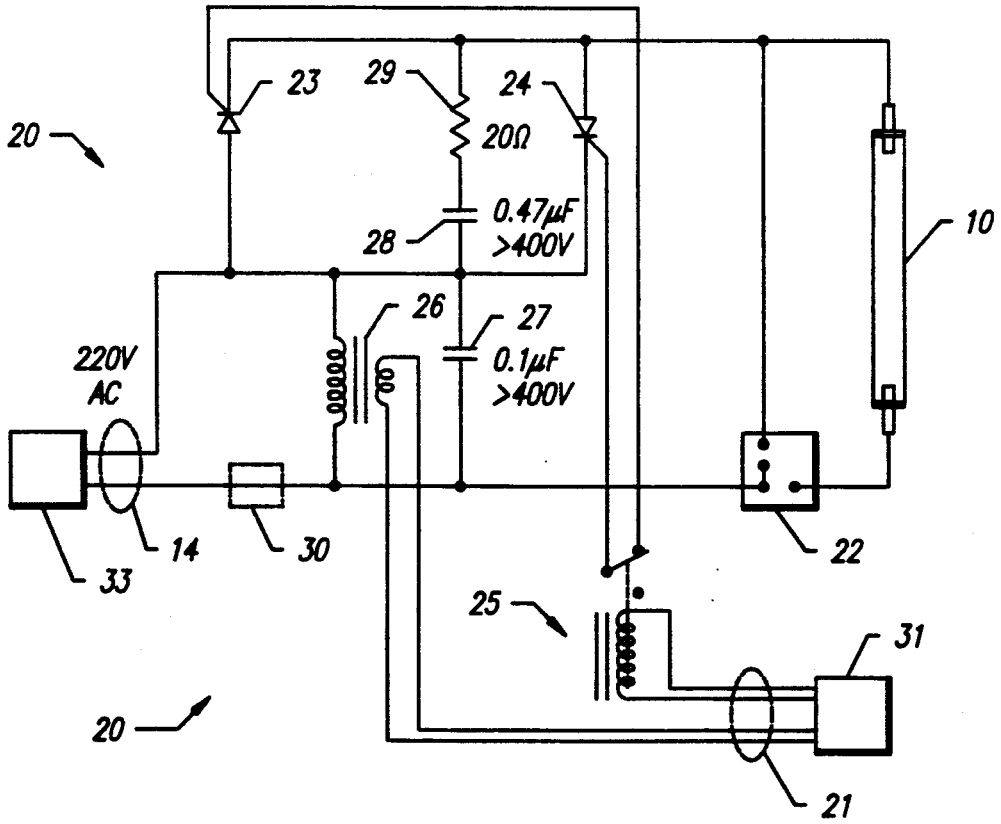
FIG. 2 is a schematic diagram of the power switch used to drive the lamp.

Turning to FIG. 2, FIG. 2 is a schematic diagram of the components used in power switch and igniter 20. The power switch igniter 20 receives 220 volt AC power via conductors in cable 14. An igniter 22, lamp 10, and a pair of SCR switching devices 23 and 24, are connected in series with the aforementioned source of power. Igniter 22 is commercially available from Kan-Men Radio Equipment, Inc. of Kan-Men Town (New Village), Yu-Huan County, Shejiang Province, China under Model No. CFII-1. This igniter accepts a 220 V input and outputs >11 KV pulses at a maximum load of 14 Amps. Preferably, the igniter should have a maximum load current in excess of 14 amps and preferably approaching 50 amps in order to give the igniter a longer life before it fails compared to the 14 amp igniter identified above. The manufacturer of the 14 amp ignitor is presently working to produce a higher current ignitor which will likely be preferred over the ignitor identified above when it becomes available.

The SCR's should be rated for 1,000 volts, 200 amps and suitable SCR's for this application are available from the Shanghai Ballast Corporation, of Shanghai, China under Model No. 3CT. For these SCR's, the igniting gate voltage is 1.8 volts, the gate current is less than 100 milliamperes, and the forward direction voltage drop is less than one volt. They are rated at 1000 Volts, 200 Amps.

The gates of the two SCR's 23, 24 are connected together by means of the contacts of a 12 volt relay 25 which is controlled by controller 50. A small series resistor may be used, if desired, to limit the gate current. When the relay closes, lamp 10 is energized. Across the SCR's are preferably connected a 20 ohm resistor 29 and a 0.47 microfarad capacitor 28. Across the input power supply is connected a 0.1 microfarad capacitor 27 as well as a 220 volt to 12 volt step down transformer 26. The secondary of transformer 26 provides a 12 volt AC source of power to controllers 50 via cable 21.

A ballast and/or fast acting circuit breaker may also be connected in series with the igniter 22, lamp 10 and SCR's 23 and 24, such as is diagrammatically depicted at numeral 30. Of course, whether or not a ballast and/or a fast acting circuit breaker is used does not particularly effect the way the present circuitry operates, but rather would be added for safety and/or because of local code requirements.

Figure 3:
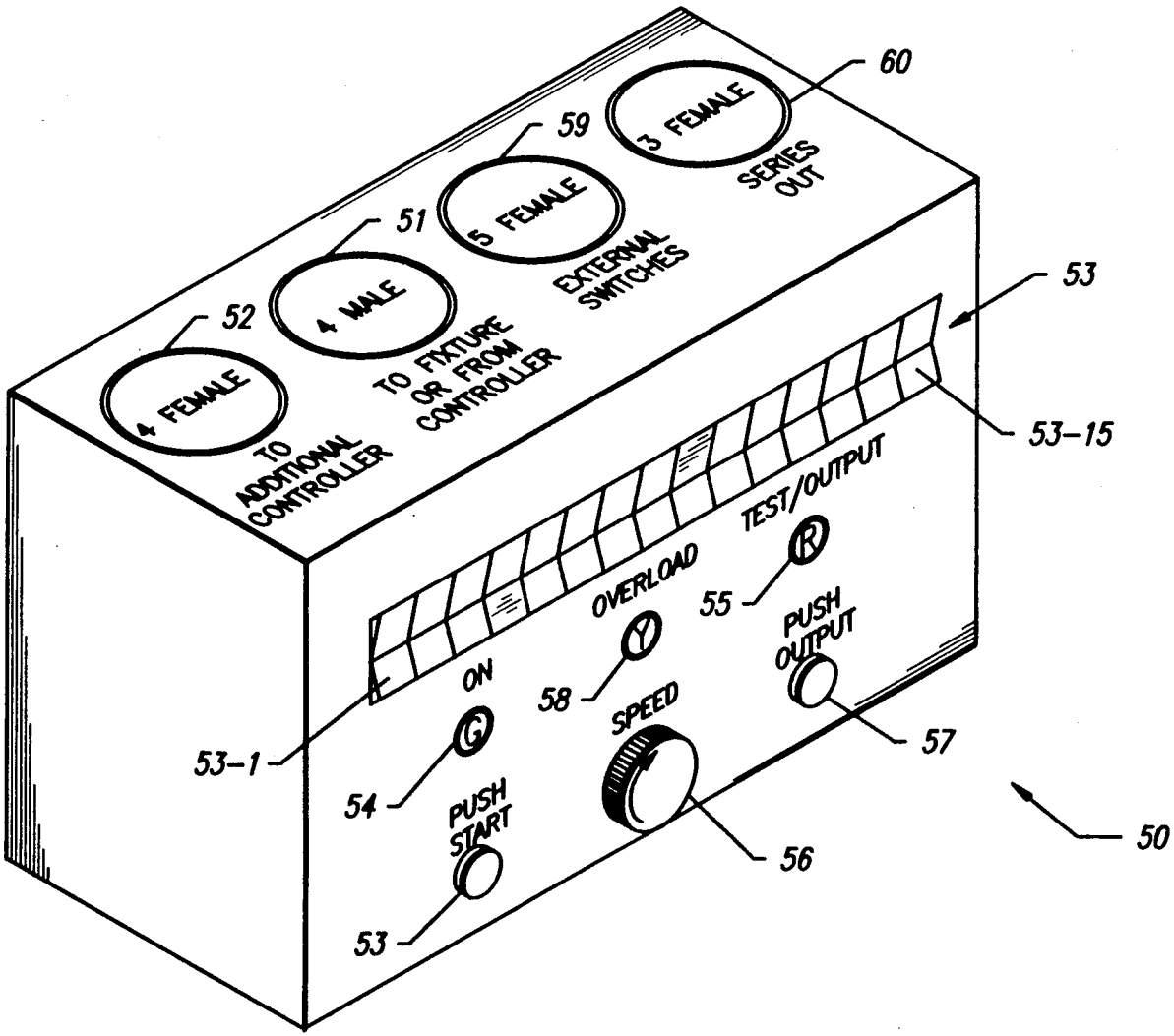
FIG. 3 is a perspective view of a housing for a control circuit used to control the power switch, this view showing the various controls, connectors and indicators which are present in the preferred embodiment of the invention.

FIG. 3 is a functional view of the various controls and connectors which would be available on the housing of controller 50. Two connectors, namely, connector 51 and connector 52, have already been described. Connector 51 may be a male connector, for example, for connecting the controller 50 either to lamp fixture 10 or from another controller 50, while connector 52 may be a female connector for connecting controller 50 to an additional controller 50.

A number of switches 53, in this case, fifteen switches, are shown on the housing. These switches are the on-off type and can be rocker switches or depression switches, as a matter of design choice.

When the start button is operated, the controller starts counting in a counter IC 65 (FIG. 4) at a speed which is controlled by a timer circuit which in turn is controlled by a potentiometer 56. As the controller counts through fifteen different states, a control signal is provided to relay 25 depending upon whether or not a switch 53 associated with each time period has been turned on. Thus, the user of the controller can control the sequencing of the flashes from lamp 10. For example, the length of the on periods and the length of the off periods of the flashes can be controlled by appropriate positioning of switches 53 and by controlling potentiometer 56.

In operation, the switches 53 are set in some pattern and if start button 82 is depressed, then the pattern of flashing which the lamp 12 will ultimately produce will appear at a Light Emitting Diode (LED) 55. Thus, the pattern of switches 53 and the speed control 56 can be varied until a suitable pattern of flashing is seen at LED 55.

Output switch 57 controls whether or not the control signal generated within the controller is actually supplied to relay 25. Thus, output switch 57 permits the flashing pattern to be tested without causing lamp 10 to be energized. Switch 57 can either be a push to close switch, or alternatively, it can be a toggle type switch. In any event, once a suitable pattern of flashing is seen at LED 55, the flashing can be tested using lamp 10 or actually used for production purposes by closing switch 57 and thereafter closing switch 82.

As will be seen, the switches 82 and 57 need not be operated locally, but rather their circuits can be closed from a remote location by an appropriate connection made to connecter 59.

As has been previously indicated, a number of controllers 50 can be connected logically in series so that after one controller counts through its fifteen states, it can cause the next controller to start counting to its fifteen states, should more than fifteen states be required for a desired pattern of flashing of lamp 10. To that end, connecter 60 provides an output which when connected to connector 59 of a controller 50 downstream, can be used to electrically close switch 82 so as to cause the pattern of flashing at the subsequent controller 50 to be initiated. Of course, many controllers can be connected together in this fashion or in parallel for more complex patterns of light. Additionally, the last controller in the series may likewise be connected to the first controller in the series making an endless loop with a continuous and repeating output sequence. This sequence begins with the closure of any switch 82 in the series and ends after the disconnection of any 2 controllers. Also, connector 59 can be used to permit the push-start switch 82 and switch 57 to be controlled from an external source or location, if desired. For example, if it were desired to control the lightning flashes to be in alignment with music or other lighting effects during the production of a theatrical work which was under, for example, MIDI control, then switch 53 could be effectively closed using a MIDI device by the external connection available through connector 59. Alternatively, a MIDI port could be placed on the housing itself so that the MIDI data could be applied directly to controller 50, as will be discussed with reference to FIG. 5.

Figure 4A:
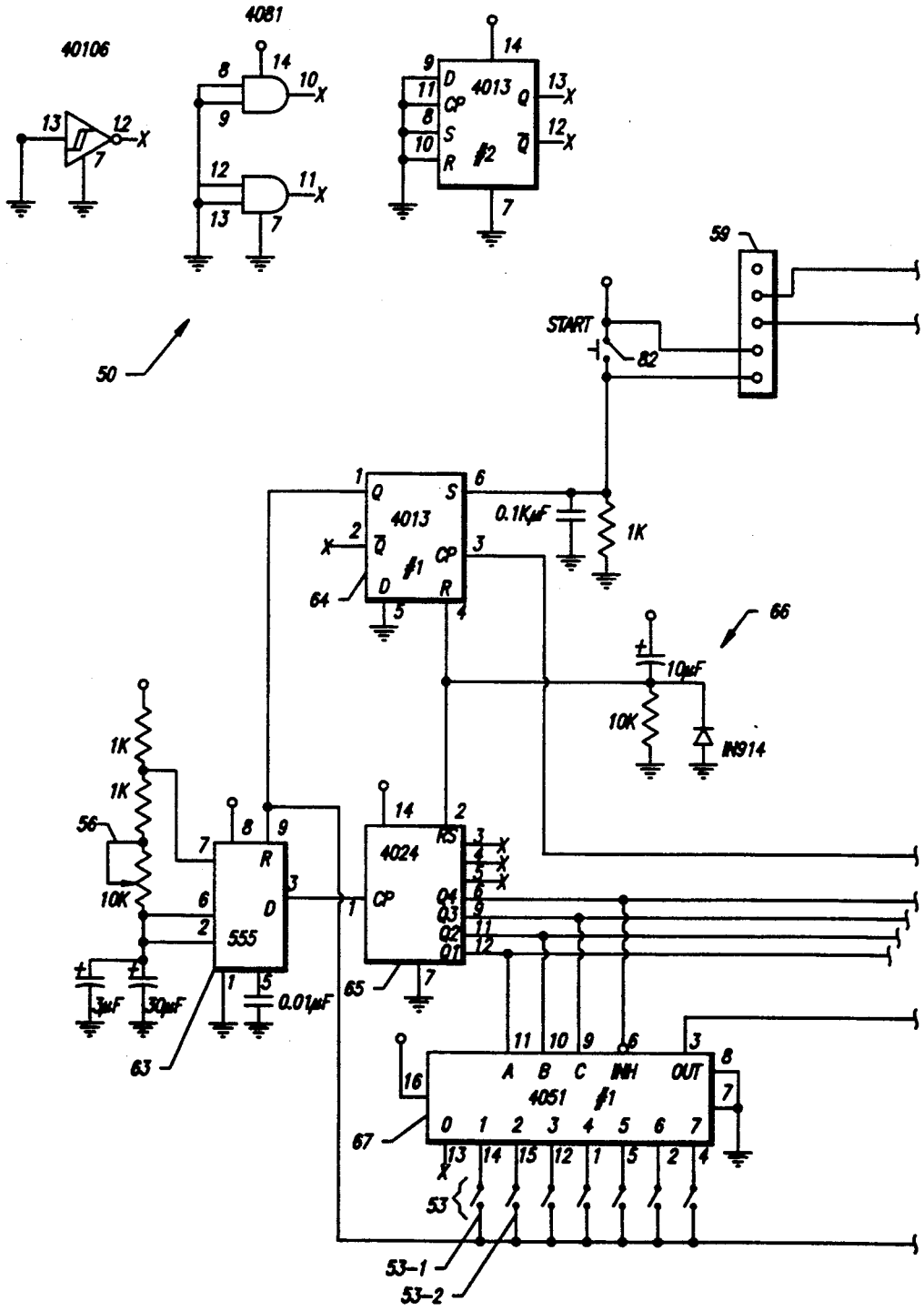
FIG. 4 is a logic diagram of the control circuit.
Figure 4B:
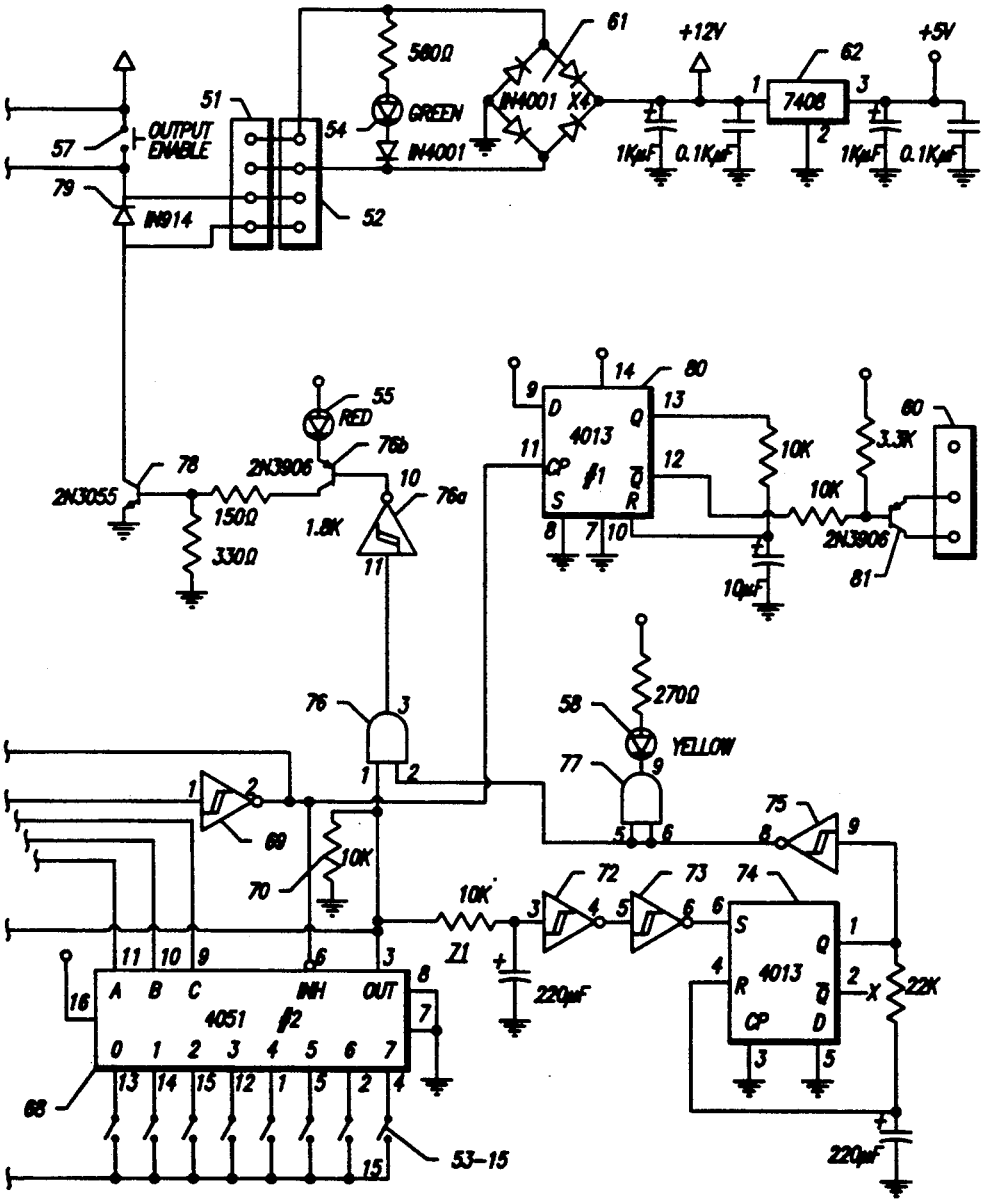

FIG. 4 is a logic diagram of controller 50. As indicated above, 12 volt AC power is applied via connector 51, the pins of which are connected to a full wave bridge rectifier 61 so as to provide a 12 volt DC source and to a regulator 62, the output of which provides a 5 volt DC source. The 5 volt DC source is used as a supply to the various IC's whereas the 12 volt DC source is used to provide the output signal to relay 25 (FIG. 2).

Potentiometer 56 controls the frequency of a timing IC 63, which is preferably provided by a type 555 IC. Timing IC 63 is reset by the Q output of flip-flop 64 which may be preferably provided by a type CD4031B IC. Flip-flop 64 is, in turn, triggered by a momentary closure of switch 82, to start counting in a counting IC 65. The output of IC 63 on pin 3 is applied to counter IC 65, which is preferably provided by a type CD2024B type IC. A power up reset circuit 66 resets both IC 64 and IC 65.

The output of counter IC 65 on pins Q1–Q4 are applied to three inputs and to an inhibit input (INH) of a pair of multiplexers demultiplexes IC's 67 and 68, the most significant bit of the output from IC 65 on Q4 being inverted by invertor 69 before being applied to IC 68. IC 67 and 68, when not inhibited, each select one of eight inputs (0–7) to be connected to its output (OUT). As can be seen, switches 53 are each wired in series with an input 1–7 of IC 67 or an input 0–7 of IC 68 with the Q output from flip-flop 64. The outputs of the two multiplexers IC 67, IC 68, are coupled together and coupled to ground via a resister 70 and are also coupled via an RC timing circuit 71 to the input of a Schmidt trigger invertor 72. The output of the Schmidt trigger 72 invertor is applied via another invertor 73 to the set (S) input of a flip-flop 74. The Q output of the flip-flop 74 is applied via an invertor 75 as one input to an AND gate 76, the other input being the outputs from IC 67 and IC 68. The output of invertor 75 is also applied via an AND gate 77, which is merely used as a driver, for LED 58.

The RC circuit 71 in combination with the Schmidt trigger invertor 72 operates with a 2.2 second time period. The RC circuit 71 in combination with the flip-flop 74 and the related circuitry causes a logic level 0 to appear on pin 2 of AND gate 76, thereby turning off that AND gate should an output from either one of the multiplexers IC's, 67 or 68, exceed 2.2 seconds. This is a safety circuit to ensure that the lamp 10 will not be energized for longer than a predetermined period of time, which in this embodiment is set at 2.2 seconds. Generally speaking, the low pressure long arc xenon lamp 10 should not be energized for more than 3 seconds continuously. Whenever the output of invertor 75 goes to a logic level 0, that causes LED 58 to light, indicating that an overload condition is occurring, thereby alerting the user of the device to reprogram it using switches 53 so as to use fewer continuous on time periods or adjust timer potentiometer 56 to use shorter time periods.

The output of AND gate 76 is coupled via an invertor **76*a* and resistor to the base of a transistor 76*b* which drives LED 55 from which the user can determine the pattern of light flashing which will occur when the switch 57 is closed. The collector of transistor 76*b* is coupled via a resistor to the base of a transistor 78 which, in turn, provides a current flow path from the 12 volt DC source via switch 57, relay 25 (FIG. 2) which is coupled via connector 51. Diode 79 protects transistor 78** from the fly back caused by the switching of current through the relay's coil in a manner well known in the art.

The closure of one or more of the switches 53 causes relay 25 to be energized whenever counter 65 counts to a count for which the associated switch is closed. There is no switch in the zero position, since that, of course, is the state which counter 65 assumes before the start button 82 is depressed. At the end of the sixteen clock cycles, the output of invertor 69 goes high and flip-flop 64 and flip-flop 80 are then reset. Flip-flop 80 is connected as a one shot so that its Q goes low for a short period of time in response to the positive going pulse outputted from invertor 69. The Q output is applied via a resistor network to the base of a transistor 81, causing that transistor 81 to go into saturation for a short period of time after counter 65 has counted through sixteen states. Those skilled in the art will appreciate the fact that when the collector and emitter of transistor 81 are connected across the start button 82 in another identical controller by suitable cabling between connector 60 of one controller and the connector 59 in the subsequent controller, that the subsequent controller is caused to immediately start counting at the conclusion of the sixteen counts in the preceding controller. Of course, the number of states through which a controller counts is a matter of design choice.

Figure 5:
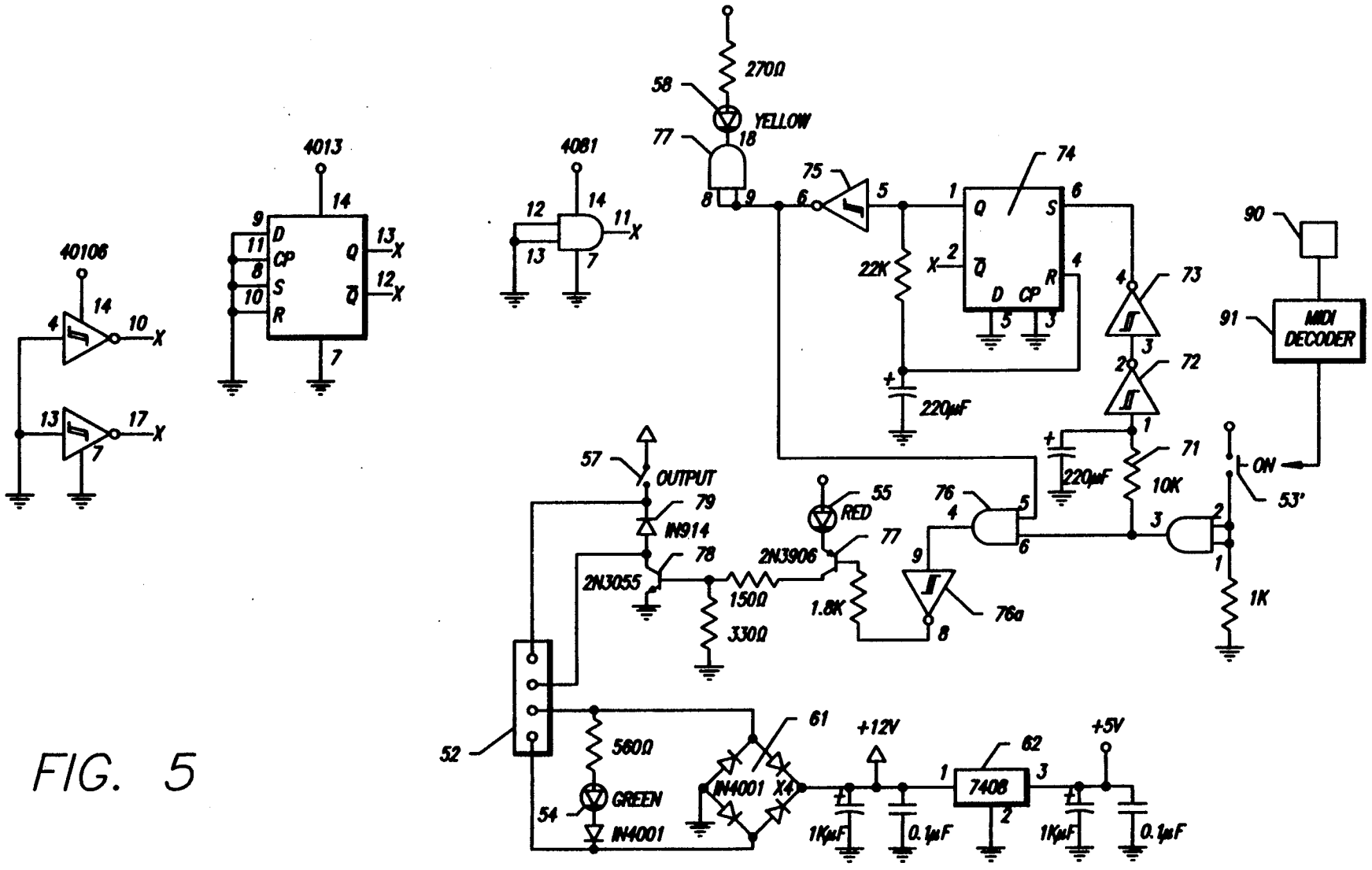
FIG. 5 is a logic diagram of a manually-operated or MIDI-operated control circuit.

FIG. 5 is a schematic diagram of a manual or MIDI lighting controller which is rather similar to the controller of FIG. 4, but does not include the timer, counter or multiplexer IC's. Instead, the flashing is controlled either manually by depression of a switch 53' or by electrically closing those contacts in response to a MIDI signal, for example, received at a connector 90 on the housing of the controller, and coupled to a MIDI decoder 91. Since the operation of the circuitry of FIG. 5 otherwise closely parallels the operation of the circuitry of FIG. 4 and since the same reference numerals have been used with reference to the components which perform the same functions in FIG. 4 and in FIG. 5, further description of this logic diagram should be unnecessary for those skilled in the art.

Having described the invention with respect to certain preferred embodiments thereof, modification may now suggest itself to those skilled in the art. The invention is therefore not to be limited to the disclosed embodiments, except as required by the appended claims.

What is claimed is:

1. A high intensity lighting system for use in producing relatively short bursts of intense light, said system comprising:

(a) a lamp containing xenon gas at a pressure less than atmospheric when at room temperature;
(b) an igniter;
(c) switching means connected in series with said lamp and with said igniter, said switching means coupling said lamp and said igniter to a source of electrical power in response to a control signal; and
(d) control means for generating said control signal, said control means including manually operated switch means for controlling when said control signal is turned on and turned off and further including means for limiting the on time period of said control signal to a predetermined maximum time period.

2. The lighting system of claim 1, wherein said lamp is an elongated lamp having electrodes disposed at the ends thereof, said lamp containing xenon gas at a pressure approximately in the range of 0.2 to 0.3 atmospheres when it is at room temperature.

3. The lighting system of claim 1, wherein said manually operated means comprise a group of switches.

4. A high intensity lighting system for use in producing relatively short bursts of light, said system comprising:
(a) a lamp;
(b) power supply means coupled to said lamp and responsive to a control signal for applying electrical power to said lamp; and
(c) control means for generating said control signal, said control means including a counter for counting through a predetermined number of states and multiplexer means responsive to said counter and to the state of selected switches so that said control signal is generated for each state of said counter when its associated switch is in a predetermined state.

5. The lighting system of claim 4, further including output inhibiting means for inhibiting said control signal from occurring longer than a predetermined maximum period of time.

6. A high intensity lighting system for use in producing relatively short bursts of light, said lighting system comprising:
(a) a lamp containing xenon gas;
(b) a power supply coupled to said lamp for igniting said lamp in response to a control signal; and
(c) control means disposed in a housing located remotely from said lamp, but operationally connected thereto, for providing said control signal to said power supply, said control means including manually operated means for controlling when said control signal is turned on and off, said housing including connectors for coupling said control signal to said power supply and further including additional connectors for connecting said control means to yet another control means thereby increasing the number of manually operated means for controlling when said control signal is turned on and off.

7. The lighting system of claim 6, wherein each control means includes a counter for counting to a predetermined number of states and means responsive to the state of said counter and to the state of said manually operated means for generating said control signal while said counter is in a given state provided that the manually operated means associated with that state is in a control signal generating state.

8. The lighting system of claim 7, wherein said manually operated means are manually operated switches.

9. The lighting system of claim 8, further including control signal limiting means for initiating the generation of said control signal to a predetermined maximum period of time.

10. The lighting system of claim 9, further including output switch means for inhibiting the passage of said control signal to said power supply means except when said output switch means is closed.

* * * * *